US006653938B2

(12) United States Patent
Yang

(10) Patent No.: US 6,653,938 B2
(45) Date of Patent: Nov. 25, 2003

(54) AUTOMATIC SECURITY ENHANCEMENT SYSTEM

(76) Inventor: George L. Yang, 15 Longfellow Ct., Freehold, NJ (US) 07728

( * ) Notice: Subject to any disclaimer, the term of this patent is extended or adjusted under 35 U.S.C. 154(b) by 0 days.

(21) Appl. No.: 10/101,116

(22) Filed: Mar. 19, 2002

(65) Prior Publication Data

US 2003/0201888 A1 Oct. 30, 2003

(51) Int. Cl.[7] ..... G08B 13/00

(52) U.S. Cl. ..... 340/541; 340/545.1; 340/565; 340/5.54; 340/5.81; 340/5.74; 713/200; 713/202; 713/194; 235/379; 235/380; 235/381; 235/382

(58) Field of Search ..... 340/541, 545.1, 340/565, 5.2, 5.1, 5.21, 5.22, 5.24, 5.25, 5.26, 5.51, 5.54, 5.61, 5.62, 5.71, 5.72, 5.8, 5.81, 5.85, 5.86, 5.7, 5.74; 705/18; 713/200, 202, 194; 235/379, 380, 381, 382, 382.5

(56) References Cited

U.S. PATENT DOCUMENTS 5,594,227 A * 1/1997 Deo ..... 235/380
5,721,542 A * 2/1998 Shpater ..... 340/525
5,790,015 A * 8/1998 Iitsuka ..... 340/425.5
6,112,078 A * 8/2000 Sormunen et al. ..... 455/411

* cited by examiner

*Primary Examiner*—Jeffery Hofsass
*Assistant Examiner*—Daniel Prévl

(57) ABSTRACT

An automatic security enhancement system can automatically increase the security of the system when necessary. The system has at least two different states with each state has different security level. The state with low security could be changed into a state with higher security automatically when the system detects someone try to break the system. The state with low security could also be instructed to change into a state with higher security. However, a state with higher security will be changed into a state with lower security only when the system is commanded to do so.

2 Claims, 2 Drawing Sheets

AUTOMATIC SECURITY ENHANCEMENT SYSTEM

FEDERALLY SPONSORED RESEARCH

Not Applicable

SEQUENCE LISTING OR PROGRAM

Not Applicable

FIELD OF THE INVENTION

The invention relates generally to the security identification system and in particular to the security identification system with the capability of automatic security level enhancement.

BACKGROUND

Living in today's society, from time to time, people are required to input their identification sequences before they are provided certain kind of service. For example, when people left their keys inside their cars, in order to enter the car through keyless entrance system, they have to input their identification sequences. Another example is garage door opener. Many garage door openers could have keypads outside the garages through which people can input their special identification code to open their garage doors. People welcome this kind of system so that they do not have to physically carry their keys everywhere. The problem is that how complex the identification sequence should be designed. If an identification sequence is short, of course, it is easy to use but the security is low. If an identification sequence is long, the security could not be a problem, but user could feel tired to input the long identification sequence especially when the user has to input it daily. Another problem is that the requirement on security could change. In the case of garage door opener, or car keyless entrance, user may hope to use short security sequence on daily base but to use long security sequence when on vacation.

The invention solves the problems by making the security system easy for regular usage while providing sufficient security when it is needed.

SUMMARY OF THE INVENTION

It is the primary object of the present invention to provide a method for a security system to be easy for daily operations and to be able to enhance security automatically when more security is needed.

It is another object of the present invention for security system to have at least two different levels of security states. These states can be switched when needed or when commanded.

BRIEF DESCRIPTION OF THE DRAWINGS

The drawing figures depict preferred embodiments of the present invention by way of example, not by way of limitations.

DETAILED DESCRIPTION OF THE PRESENTLY PREFERRED EMBODIMENTS

Detailed description of the preferred embodiment is provided herein. The embodiment illustrates a security system that has a long identification sequence and a short identification sequence. However, it is to be understood that the present invention may be embodied in many different ways. For example, for those killed in the art, it could be easy to modify the embodiment to cover the situation where multiple long identification sequences and multiple short identification sequences are allowed. Therefore, specific details disclosed are not to be interpreted as limiting, but rather as a basis for the claims and as a representative basis for teaching one to employ the present invention in virtually any appropriately detailed system, structure or manner.

Figure 1:
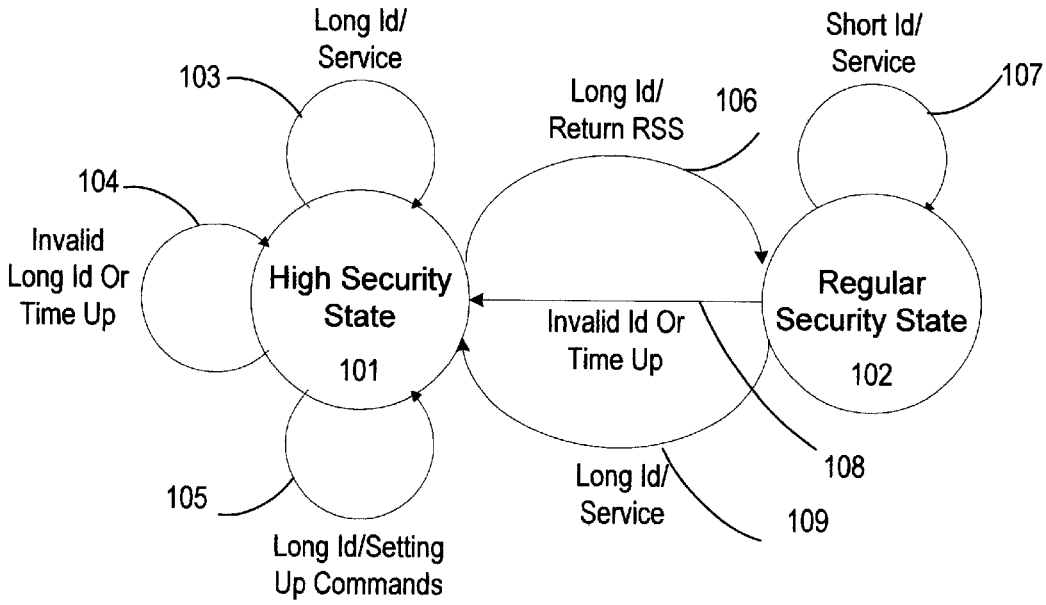
FIG. 1 illustrates a security enhancement system in state diagram form.

FIG. 1 illustrates a security enhancement system in state diagram form. There are two states, one is called the High Security State (HSS) 101 and another is called Regular Security State (RSS) 102. The security system could be in one of these states. The system will check if the input identification sequence matches one of the current effective identification sequences stored in the system. An indicator such as a LED could be used to indicate which security state the system is.

When system is in HSS 101, the current effective identification sequence is a long sequence. Therefore, the system will expect user to input a long identification sequence, verify if the sequence is valid, and decide if it should provide user service. Here the service could be opening garage door, unlocking the car door, or starting the car, and etc. If the input long identification sequence is valid, the system will provide the service and stay in HSS as shown by "Long Id/Service" 103. If the input long identification sequence is not valid or the time between two input symbols is beyond a predefined amount of time, the system will not provide the service but will stay in HSS 101 as shown by "Invalid Id Or Time Up" 104. User can change the setting when the system is in HSS 101 as shown by "Long Id/Setting Up Commands" 105. A special setting is to let the system go to RSS 102 as shown by "Short Id/Return RSS" 106. There could be other setting such as changing a short identification sequence.

When the system is in RSS 102, the current effective identification sequences could include both the long and the short identification sequences. Therefore, the system will expect user to input either a short identification sequence or a long identification sequence, verify if the sequence is valid, and decide if it should provide the user service. If input identification sequence is short and correct, the system will provide service and stay in this state as shown by "Short Id/Service" 107. If input identification sequence is not a valid one, or if the time between two input symbols is beyond a predefined amount of time, the system will switch to HSS 101 as shown by "Invalid Id Or Time Up" 108. If the input identification sequence is a correct long sequence, the system will switch to HSS 101 and provide service as shown by "Long Id/Service" 109.

Figure 2:
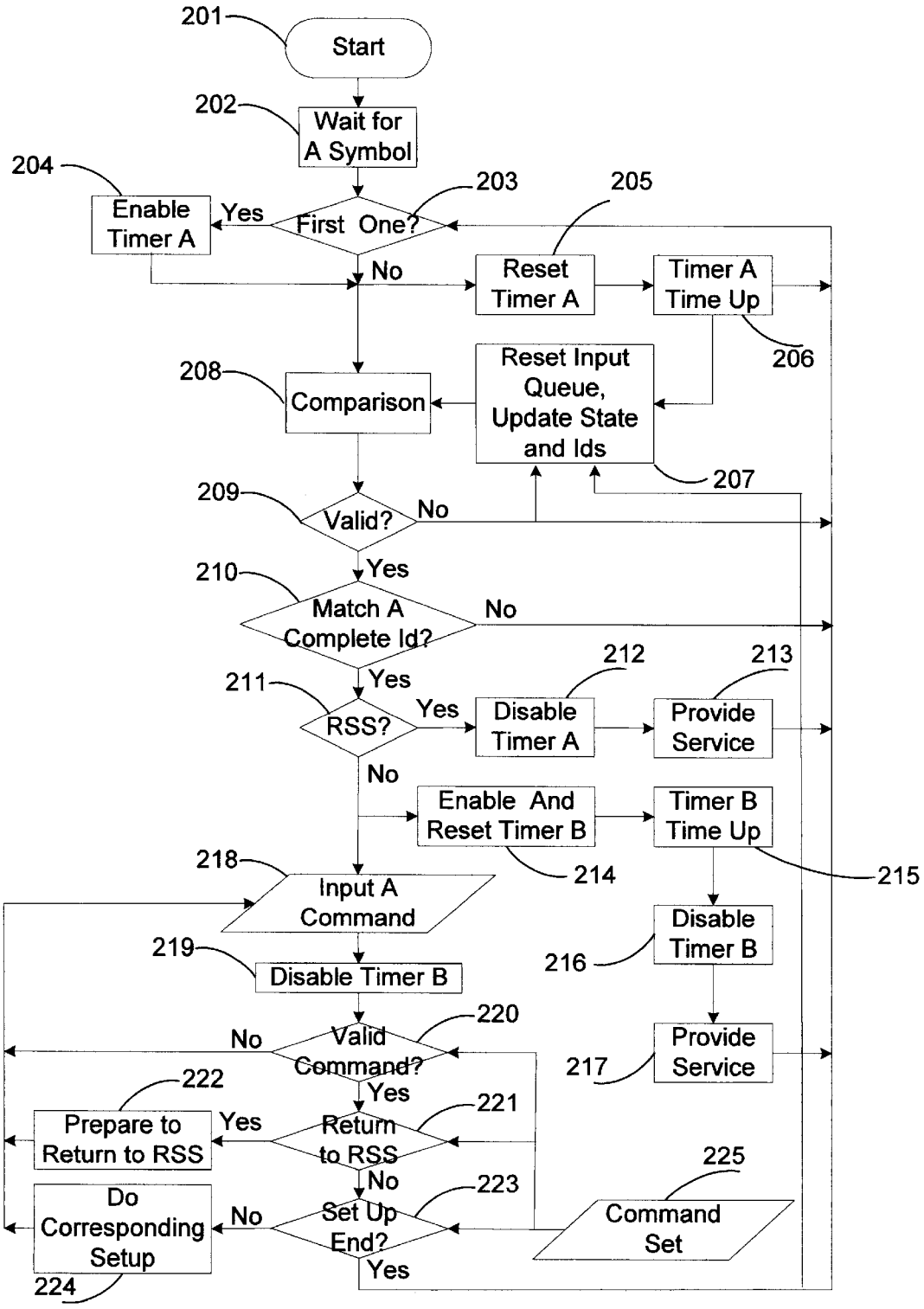
FIG. 2 illustrates a security enhancement system in flow diagram form.

FIG. 2 illustrates an example of the implementation of the security enhancement system in flow diagram form. The system starts at step 201 and makes a new session. At step 202, the system is waiting for user to input a symbol from an input device such as a keypad. An identification sequence consists of series of symbols. The input device could generate these symbols directly or indirectly. A symbol could correspond directly with a digit, or a letter, or any other sign on the input device. A symbol could also correspond to a set of digits, letters, other signs and their combinations. One set could be separated from another set by making the last sign in a set being a special mark such as # sign or allowing sufficient time elapsed after the last sign in a set.

At step 203, check if the input symbol is the first one of this session. If it is the first one, enable the timer A at step

204. There are two branches at the output of step 203. One branch is to reset Timer A at step 205. When the time between two continuing symbols exceeds some predetermined amount of time, at step 206, so that the Timer A will cause a time up interrupt when time is up. When the time up interrupt happens, at step 207, the system will reset the input queue, enter HSS 101, let the long identification sequence be the only valid identification sequence, and return to step 202 to start a new session.

Another branch is to go to step 208 where the input symbol is compared with the corresponding symbols of all currently possible candidates. At step 209, test if the input symbol could be a valid one. If yes, go to step 210. Otherwise, reset the input queue, enter HSS 101, let the long identification sequence be the only valid identification sequence, and return to step 202 to start a new session.

At step 210, test if there is a complete match. If no, go to step 202 and wait for the next symbol. If there is a complete match, go to step 211.

At step 211, test if the current state is RSS 102. If yes, disable Timer A at step 212, provide service at step 213, and return to step 212 to start a new session.

If the current state is HSS 101, there are two branches. One branch is to go to step 214 to enable and reset Timer B. If there is no any further input when the Timer B reaches a predetermined amount of time, there will be a time up interrupt at step 215. When the time up interrupt happens, the system will disable the Timer B at step 216, provide service at step 217, and return to step 202 to start a new session.

Another branch is to go to step 218 where a command is expected to input. A command is also a sequence of symbols and its length is usually much shorter than the length of a short identification sequence. A command is used to tell the system to do various setting up after the input long identification sequence is verified. At step 219, disable Timer B. At step 220, test if the input command is a valid one. If no, go back to step 218 and wait for the next command. If yes, go to step 221 to test if the command is "Return to RSS" command. If yes, at step 222, prepare to switch to RSS 102 and return to step 218. If not, at step 223, test if the command is "Setup End" command. If not, at step 224, do corresponding setting and return to 218. If yes, reset input queue, update the state, and load corresponding effective set of identification sequences as shown by step 207 and return to step 202 to start a new session.

Another operand for making decision at step 220, step 221 and step 223 is from "Setup Command Set" as shown by 225.

What is claimed is:

1. An automatic security updating system comprising:

a first state where a regular length of identification sequence is required before providing service, a second state where a significant long length of identification sequence is required before providing service and system configuration, whereby if the system is in the first state, it will stay in the first state unless when the system detects a possible attack, it will be switched to the second state, and whereby if the system is in second state, it will stay in the second state unless the system is commanded to switch to the first state.

2. An automatic security updating system comprising:

plurality of states with a different state requiring a different length of identification sequence before providing service and system configuration corresponding to that state, whereby if the system is in a state with a shorter length of identification sequence, it will stay in the state unless when the system detects a possible attack, it will be switched to a state with a longer length of identification sequence, and whereby if the system is in a state with a longer length of identification sequence, it will stay in the state unless the system is commanded to switch to a state with a shorter length of identification sequence.

* * * * *